US012735972B2

(12) United States Patent
Guedes de Carvalho et al.

(10) Patent No.: US 12,735,972 B2
(45) Date of Patent: Sep. 15, 2026

(54) APPROACHES TO GENERATING RECORDS ABOUT WELLSITE EVENTS

(71) Applicant: Schlumberger Technology Corporation, Sugar Land, TX (US)

(72) Inventors: Rafael Guedes de Carvalho, Katy, TX (US); Diego Fernando Patino Virano, Doha (QA)

(73) Assignee: Schlumberger Technology Corporation, Sugar Land, TX (US)

( * ) Notice: Subject to any disclaimer, the term of this patent is extended or adjusted under 35 U.S.C. 154(b) by 581 days.

(21) Appl. No.: 18/334,464

(22) Filed: Jun. 14, 2023

(65) Prior Publication Data

US 2023/0399935 A1 Dec. 14, 2023

Related U.S. Application Data

(60) Provisional application No. 63/366,330, filed on Jun. 14, 2022.

(51) Int. Cl.
*E21B 44/00* (2006.01)

(52) U.S. Cl.
CPC ..... *E21B 44/00* (2013.01); *E21B 2200/22* (2020.05)

(58) Field of Classification Search
None
See application file for complete search history.

(56) References Cited

U.S. PATENT DOCUMENTS 11,047,222 B2 6/2021 Benson et al.
2007/0057811 A1* 3/2007 Mehta ..... E21B 47/12 340/853.3
2008/0156531 A1* 7/2008 Boone ..... E21B 44/00 175/27
2008/0270328 A1* 10/2008 Lafferty ..... E21B 43/00 702/183
2009/0028881 A1 1/2009 Brandt et al.
2014/0277752 A1* 9/2014 Chang ..... E21B 44/00 700/275
2018/0171774 A1 6/2018 Ringer et al.
2018/0187498 A1* 7/2018 Sanchez Soto ..... E21B 21/08
2018/0359339 A1* 12/2018 Zheng ..... H04L 67/12
2020/0118675 A1* 4/2020 Schriver ..... G16H 40/40
2020/0182036 A1* 6/2020 Rangarajan ..... E21B 43/12
(Continued)

FOREIGN PATENT DOCUMENTS

CA 3115224 A1 4/2020

OTHER PUBLICATIONS

Almaghaslah, A. M. et al., "Empowering Knowledge Management by Human Engagement", SPE-183441-MS, prepared for presentation at the Abu Dhabi International Petroleum Exhibition & Conference held in Abu Dhabi, UAE, 2016, 9 pages.
(Continued)

*Primary Examiner* — Lina Cordero
(74) *Attorney, Agent, or Firm* — Kyle R. Miiller

(57) ABSTRACT

A drilling system includes a knowledge manager that monitors drilling information for the drilling system. The knowledge manager identifies a trigger event based on drilling information that is outside of a threshold range of values for the drilling information. The trigger event is based a knowledge type. The knowledge manager prepares a mitigation action, such as an alert and/or a change to drilling parameters, to mitigate the trigger event.

13 Claims, 8 Drawing Sheets

(56) References Cited

U.S. PATENT DOCUMENTS

| | | | | |
|---|---|---|---|---|
| 2020/0277848 | A1* | 9/2020 | Johnston | E21B 44/00 |
| 2020/0291764 | A1* | 9/2020 | Chahine | E21B 44/00 |
| 2021/0404327 | A1 | 12/2021 | Fitzgerald et al. | |
| 2022/0026596 | A1 | 1/2022 | Jeong et al. | |
| 2022/0178248 | A1 | 6/2022 | Chambon | |
| 2023/0151727 | A1* | 5/2023 | Neal, III | E21B 41/00 166/250.01 |
| 2023/0215554 | A1* | 7/2023 | Roh | A61B 34/20 |

OTHER PUBLICATIONS

Search Report and Written Opinion of International Patent Application No. PCT/US2023/068397 dated Oct. 23, 2023, 12 pages.

* cited by examiner

APPROACHES TO GENERATING RECORDS ABOUT WELLSITE EVENTS

CROSS-REFERENCE TO RELATED APPLICATIONS

This application claims priority to and the benefit of U.S. Provisional Patent Application No. 63/366,330, filed on 14 Jun. 2022, which are hereby incorporated by reference in their entireties.

BACKGROUND

Unless otherwise indicated, this section does not describe prior art to the claims and is not admitted prior art.

Capturing information about operations at a wellsite may be a manual process and tedious for wellsite personnel. An individual's willingness to record the information may vary from one person to another, and may be dependent on incentives (e.g., setting goals or key performance objectives around entering knowledge capture tickets) that may vary from company to company and are highly dependent on individual motivation, As a result, information may be lost or not captured if the wellsite personnel do not enter it.

Where information is captured, it is often captured on a piece of paper, an email, a word processing document, a spreadsheet, or some combination of the above. As a result, the information, which may be valuable to others, is often unavailable or difficult to find for those who would benefit from it.

For the above reasons and others, valuable information may be lost or unavailable to wellsite personnel, operators, and planners. This may cause the same mistakes to be repeated, and valuable lessons learned from one operation to be unavailable for the next operation.

SUMMARY

In this document, approaches to capturing information and data are described to help preserve knowledge and make it more accessible. A non-transitory computer readable medium may store instructions. These instructions may include detecting a trigger event during a wellsite operation and, in response to detecting the trigger event, capturing event data from systems and sensors at the time of the trigger event, capturing plan information that describes the activity being performed during the wellsite operation when the trigger event was detected, and prompting a user to enter manual information about the trigger event.

The trigger event may be a drilling dysfunction (or a likely drilling dysfunction), a near-miss event, a deviation from the plan, or other event. The manual information may be labels, categorization, or free text (such as comments, observations, other sensor data, etc.).

The event data may be a time stamp, a current depth, the drilling parameters being used at the time of the trigger event, surface sensor readings, the procedure being executed at the time of the event, or other. The plan information may include information such as a planned procedure, standard operating procedures, planned drilling parameters, or others.

Detecting the trigger event may include monitoring data sources and determining, from the data sources, that the trigger event has occurred. This may include monitoring manual entries by personnel in reporting systems, surface sensor data, downhole sensor data, plan information, or other data sources. The manual information about the trigger event, the event data, and the plan information may be stored in a data storage solution such as a database. The approach may generate a report of trigger events. For example, the report may be generated after completion of the wellsite operation. In one embodiment, the report also generates a likelihood of certain trigger events occurring for a new well being planned.

This summary introduces some of the concepts that are further described below in the detailed description. Other concepts and features are described below. The claims may include concepts in this summary or other parts of the description.

BRIEF DESCRIPTION OF THE DRAWINGS

The figures below are not necessarily to scale; dimensions may be altered to help clarify or emphasize certain features.

DETAILED DESCRIPTION

Introduction

Figure 1:
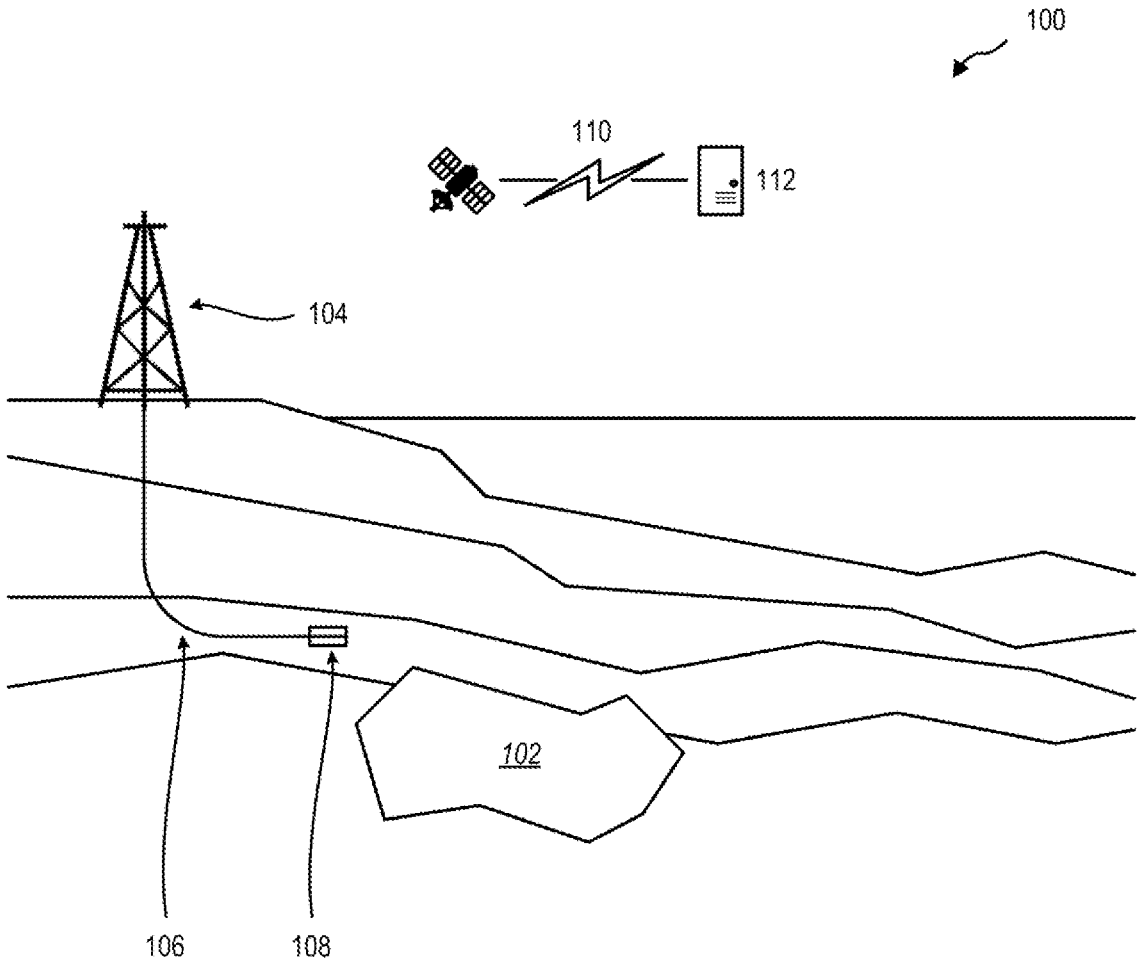
FIG. 1 illustrates an example of an environment in which drilling may take place, according to at least one embodiment of the present disclosure.

The following detailed description refers to the accompanying drawings. Wherever convenient, the same reference numbers are used in the drawings and the following description refers to the same or similar parts. While several embodiments and features of the present disclosure are described herein, modifications, adaptations, and other implementations are possible, without departing from the spirit and scope of the present disclosure.

Although the terms "first", "second", etc. may be used herein to describe various elements, these terms are used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Embodiments

FIG. 1 illustrates one example of an environment 100 in which drilling may occur. The environment may include a reservoir 102 and various geological features, such as stratified layers. The geological aspects of the environment 100 may contain other features such as faults, basins, and others. The reservoir 102 may be located on land or offshore.

The environment 100 may be outfitted with sensors, detectors, actuators, etc. to be used in connection with the drilling process. FIG. 1 illustrates equipment 104 associated with a well 106 being constructed using downhole equipment 108. The downhole equipment 108 may be, for example, part of a bottom hole assembly (BHA). The BHA may be used to drill the well 106. The downhole equipment 108 may communicate information to the equipment 104 at the surface, and may receive instructions and information from the surface equipment 104 as well. The surface equipment 104 and the downhole equipment 108 may communicate using various communications techniques, such as mud-pulse telemetry, electromagnetic (EM) telemetry, or others depending on the equipment and technology in use for the drilling operation.

The surface equipment 104 may also include communications means to communicate over a network 110 to remote computing devices 112. For example, the surface equipment 104 may communicate data using a satellite network to computing devices 112 supporting a remote team monitoring and assisting in the creation of the well 106 and other wells in other locations. Depending on the communications infrastructure available at the wellsite, various communications equipment and techniques (cellular, satellite, wired Internet connection, etc.) may be used to communicate data from the surface equipment 104 to the remote computing devices 112. In some embodiments, the surface equipment 104 sends data from measurements taken at the surface and measurements taken downhole by the downhole equipment 108 to the remote computing devices 112.

During the well construction process, a variety of operations (such as cementing, wireline evaluation, testing, etc.) may also be conducted. In such embodiments, the data collected by tools and sensors that are used for reasons such as reservoir characterization may also be collected and transmitted by the surface equipment 104.

In FIG. 1, the well 106 includes a substantially horizontal portion (e.g., lateral portion) that may intersect with one or more fractures. For example, a well in a shale formation may pass through natural fractures, artificial fractures (e.g., hydraulic fractures), or a combination thereof. Such a well may be constructed using directional drilling techniques as described herein. However, these same techniques may be used in connection with other types of directional wells (such as slant wells, S-shaped wells, deep inclined wells, and others) and are not limited to horizontal wells.

Figure 2:
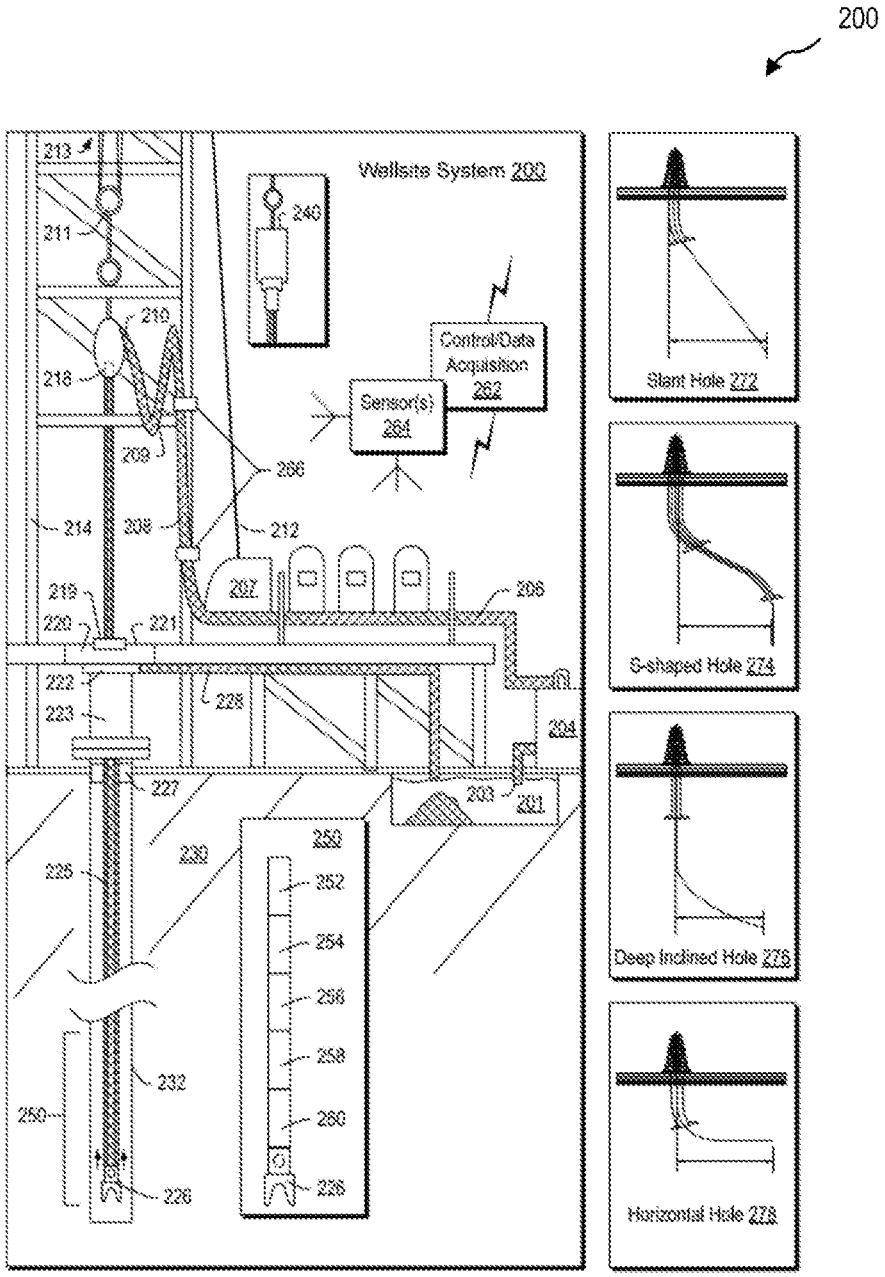
FIG. 2 illustrates an example of a drilling system that may be used to drill a well, according to at least one embodiment of the present disclosure.

FIG. 2 shows an example of a wellsite system 200 (e.g., at a wellsite that may be onshore or offshore). As shown, the wellsite system 200 may include a mud tank 201 for holding mud and other material (e.g., where mud may be a drilling fluid), a suction line 203 that serves as an inlet to a mud pump 204 for pumping mud from the mud tank 201 such that mud flows to a vibrating hose 206, a drawworks 207 for winching drill line or drill lines 212, a standpipe 208 that receives mud from the vibrating hose 206, a kelly hose 209 that receives mud from the standpipe 208, a gooseneck or goosenecks 210, a traveling block 211, a crown block 213 for carrying the traveling block 211 via the drill line or drill lines 212, a derrick 214, a kelly 218 or a top drive 240, a kelly drive bushing 219, a rotary table 220, a drill floor 221, a bell nipple 222, one or more blowout preventors (BOPs) 223, a drillstring 225, a drill bit 226, a casing head 227 and a flow pipe 228 that carries mud and other material to, for example, the mud tank 201.

In the example system of FIG. 2, a borehole 232 is formed in subsurface formations 230 by rotary drilling; noting that various example embodiments may also use one or more directional drilling techniques, equipment, etc.

As shown in the example of FIG. 2, the drillstring 225 is suspended within the borehole 232 and has a drillstring assembly 250 that includes the drill bit 226 at its lower end. As an example, the drillstring assembly 250 may be a bottom hole assembly (BHA).

The wellsite system 200 may provide for operation of the drillstring 225 and other operations. As shown, the wellsite system 200 includes the traveling block 211 and the derrick 214 positioned over the borehole 232. As mentioned, the wellsite system 200 may include the rotary table 220 where the drillstring 225 may pass through an opening in the rotary table 220.

As shown in the example of FIG. 2, the wellsite system 200 may include the kelly 218 and associated components, etc., or a top drive 240 and associated components. As to a kelly example, the kelly 218 may be a square or hexagonal metal/alloy bar with a hole drilled therein that serves as a mud flow path. The kelly 218 may be used to transmit rotary motion from the rotary table 220 via the kelly drive bushing 219 to the drillstring 225, while allowing the drillstring 225 to be lowered or raised during rotation. The kelly 218 may pass through the kelly drive bushing 219, which may be driven by the rotary table 220. As an example, the rotary table 220 may include a master bushing that operatively couples to the kelly drive bushing 219 such that rotation of the rotary table 220 may turn the kelly drive bushing 219 and hence the kelly 218. The kelly drive bushing 219 may include an inside profile matching an outside profile (e.g., square, hexagonal, etc.) of the kelly 218; however, with slightly larger dimensions so that the kelly 218 may freely move up and down inside the kelly drive bushing 219.

As to a top drive example, the top drive 240 may provide functions performed by a kelly and a rotary table. The top drive 240 may turn the drillstring 225. As an example, the top drive 240 may include one or more motors (e.g., electric and/or hydraulic) connected with appropriate gearing to a short section of pipe called a quill, that in turn may be screwed into a saver sub or the drillstring 225 itself. The top drive 240 may be suspended from the traveling block 211, so the rotary mechanism is free to travel up and down the derrick 214. As an example, a top drive 240 may allow for drilling to be performed with more joint stands than a kelly/rotary table approach.

In the example of FIG. 2, the mud tank 201 may hold mud, which may be one or more types of drilling fluids. As an example, a wellbore may be drilled to produce fluid, inject fluid or both (e.g., hydrocarbons, minerals, water, etc.).

In the example of FIG. 2, the drillstring 225 (e.g., including one or more downhole tools) may be composed of a series of pipes threadably connected together to form a long tube with the drill bit 226 at the lower end thereof. As the drillstring 225 is advanced into a wellbore for drilling, at some point in time prior to or coincident with drilling, the mud may be pumped by the pump 204 from the mud tank 201 (e.g., or other source) via the lines 206, 208 and 209 to a port of the kelly 218 or, for example, to a port of the top drive 240. The mud may then flow via a passage (e.g., or passages) in the drillstring 225 and out of ports located on the drill bit 226 (see, e.g., a directional arrow). As the mud exits the drillstring 225 via ports in the drill bit 226, it may then circulate upwardly through an annular region between an outer surface(s) of the drillstring 225 and surrounding wall(s) (e.g., open borehole, casing, etc.), as indicated by directional arrows. In such a manner, the mud lubricates the drill bit 226 and carries heat energy (e.g., frictional or other energy) and formation cuttings to the surface where the mud (e.g., and cuttings) may be returned to the mud tank 201, for example, for recirculation (e.g., with processing to remove cuttings, etc.).

The mud pumped by the pump 204 into the drillstring 225 may, after exiting the drillstring 225, form a mudcake that lines the wellbore which, among other functions, may reduce friction between the drillstring 225 and surrounding wall(s) (e.g., borehole, casing, etc.). A reduction in friction may facilitate advancing or retracting the drillstring 225. During a drilling operation, the entire drillstring 225 may be pulled from a wellbore and optionally replaced, for example, with a new or sharpened drill bit, a smaller diameter drillstring, etc. As mentioned, the act of pulling a drillstring out of a hole or replacing it in a hole is referred to as tripping. A trip may be referred to as an upward trip or an outward trip or as a downward trip or an inward trip depending on trip direction.

As an example, consider a downward trip where upon arrival of the drill bit 226 of the drillstring 225 at a bottom of a wellbore, pumping of the mud commences to lubricate the drill bit 226 for purposes of drilling to enlarge the wellbore. As mentioned, the mud may be pumped by the pump 204 into a passage of the drillstring 225 and, upon filling of the passage, the mud may be used as a transmission medium to transmit energy, for example, energy that may encode information as in mud-pulse telemetry.

As an example, mud-pulse telemetry equipment may include a downhole device configured to effect changes in pressure in the mud to create an acoustic wave or waves upon which information may modulated. In such an example, information from downhole equipment (e.g., one or more modules of the drillstring 225) may be transmitted uphole to an uphole device, which may relay such information to other equipment for processing, control, etc.

As an example, telemetry equipment may operate via transmission of energy via the drillstring 225 itself. For example, consider a signal generator that imparts coded energy signals to the drillstring 225 and repeaters that may receive such energy and repeat it to further transmit the coded energy signals (e.g., information, etc.).

As an example, the drillstring 225 may be fitted with telemetry equipment 252 that includes a rotatable drive shaft, a turbine impeller mechanically coupled to the drive shaft such that the mud may cause the turbine impeller to rotate, a modulator rotor mechanically coupled to the drive shaft such that rotation of the turbine impeller causes said modulator rotor to rotate, a modulator stator mounted adjacent to or proximate to the modulator rotor such that rotation of the modulator rotor relative to the modulator stator creates pressure pulses in the mud, and a controllable brake for selectively braking rotation of the modulator rotor to modulate pressure pulses. In such example, an alternator may be coupled to the aforementioned drive shaft where the alternator includes at least one stator winding electrically coupled to a control circuit to selectively short the at least one stator winding to electromagnetically brake the alternator and thereby selectively brake rotation of the modulator rotor to modulate the pressure pulses in the mud.

In the example of FIG. 2, an uphole control and/or data acquisition system 262 may include circuitry to sense pressure pulses generated by telemetry equipment 252 and, for example, communicate sensed pressure pulses or information derived therefrom for process, control, etc.

The assembly 250 of the illustrated example includes a logging-while-drilling (LWD) module 254, a measurement-while-drilling (MWD) module 256, an optional module 258, a rotary-steerable system (RSS) and/or motor 260, and the drill bit 226. Such components or modules may be referred to as tools where a drillstring may include a plurality of tools.

As to an RSS, it involves technology utilized for directional drilling. Directional drilling involves drilling into the Earth to form a deviated bore such that the trajectory of the bore is not vertical; rather, the trajectory deviates from vertical along one or more portions of the bore. As an example, consider a target that is located at a lateral distance from a surface location where a rig may be stationed. In such an example, drilling may commence with a vertical portion and then deviate from vertical such that the bore is aimed at the target and, eventually, reaches the target. Directional drilling may be implemented where a target may be inaccessible from a vertical location at the surface of the Earth, where material exists in the Earth that may impede drilling or otherwise be detrimental (e.g., consider a salt dome, etc.), where a formation is laterally extensive (e.g., consider a relatively thin yet laterally extensive reservoir), where multiple bores are to be drilled from a single surface bore, where a relief well is desired, etc.

One approach to directional drilling involves a mud motor; however, a mud motor may present some challenges depending on factors such as rate of penetration (ROP), transferring weight to a bit (e.g., weight on bit, WOB) due to friction, etc. A mud motor may be a positive displacement motor (PDM) that operates to drive a bit (e.g., during directional drilling, etc.). A PDM operates as drilling fluid is pumped through it where the PDM converts hydraulic power of the drilling fluid into mechanical power to cause the bit to rotate.

As an example, a PDM may operate in a combined rotating mode where surface equipment is utilized to rotate a bit of a drillstring (e.g., a rotary table, a top drive, etc.) by rotating the entire drillstring and where drilling fluid is utilized to rotate the bit of the drillstring. In such an example, a surface RPM (SRPM) may be determined by use of the surface equipment and a downhole RPM of the mud motor may be determined using various factors related to flow of drilling fluid, mud motor type, etc. As an example, in the combined rotating mode, bit RPM may be determined or estimated as a sum of the SRPM and the mud motor RPM, assuming the SRPM and the mud motor RPM are in the same direction.

As an example, a PDM mud motor may operate in a so-called sliding mode, when the drillstring is not rotated from the surface. In such an example, a bit RPM may be determined or estimated based on the RPM of the mud motor.

An RSS may drill directionally where there is continuous rotation from surface equipment, which may alleviate the sliding of a steerable motor (e.g., a PDM). An RSS may be deployed when drilling directionally (e.g., deviated, horizontal, or extended-reach wells). An RSS may aim to minimize interaction with a borehole wall, which may help to preserve borehole quality. An RSS may aim to exert a relatively consistent side force akin to stabilizers that rotate with the drillstring or orient the bit in the desired direction while continuously rotating at the same number of rotations per minute as the drillstring.

The LWD module 254 may be housed in a suitable type of drill collar and may contain one or a plurality of selected types of logging tools. It will also be understood that more than one LWD and/or MWD module may be employed, for example, as represented at by the module 256 of the drillstring assembly 250. Where the position of an LWD module is mentioned, as an example, it may refer to a module at the position of the LWD module 254, the module 256, etc. An LWD module may include capabilities for measuring, processing, and storing information, as well as for communicating with the surface equipment. In the illustrated example, the LWD module 254 may include a seismic measuring device.

The MWD module 256 may be housed in a suitable type of drill collar and may contain one or more devices for measuring characteristics of the drillstring 225 and the drill bit 226. As an example, the MWD module 256 may include equipment for generating electrical power, for example, to power various components of the drillstring 225. As an example, the MWD module 256 may include the telemetry equipment 252, for example, where the turbine impeller may generate power by flow of the mud; it being understood that other power and/or battery systems may be employed for purposes of powering various components. As an example, the MWD module 256 may include one or more of the following types of measuring devices: a weight-on-bit measuring device, a torque measuring device, a vibration measuring device, a shock measuring device, a stick slip measuring device, a direction measuring device, and an inclination measuring device.

FIG. 2 also shows some examples of types of holes that may be drilled. For example, consider a slant hole 272, an S-shaped hole 274, a deep inclined hole 276 and a horizontal hole 278.

As an example, a drilling operation may include directional drilling where, for example, at least a portion of a well includes a curved axis. For example, consider a radius that defines curvature where an inclination with regard to the vertical may vary until reaching an angle between about 30 degrees and about 60 degrees or, for example, an angle to about 90 degrees or possibly greater than about 90 degrees.

As an example, a directional well may include several shapes where each of the shapes may aim to meet particular operational demands. As an example, a drilling process may be performed on the basis of information as and when it is relayed to a drilling engineer. As an example, inclination and/or direction may be modified based on information received during a drilling process.

As an example, deviation of a bore may be accomplished in part by use of a downhole motor and/or a turbine. As to a motor, for example, a drillstring may include a positive displacement motor (PDM).

As an example, a system may be a steerable system and may include equipment to perform method such as geosteering. As mentioned, a steerable system may be or include an RSS. As an example, a steerable system may include a PDM or a turbine on a lower part of a drillstring where, just above a drill bit, a bent sub may be mounted. As an example, above a PDM, MWD equipment that provides real time or near real time data of interest (e.g., inclination, direction, pressure, temperature, real weight on the drill bit, torque stress, etc.) and/or LWD equipment may be installed. As to the latter, LWD equipment may make it possible to send various types of data of interest to the surface, including for example, geological data (e.g., gamma ray log, resistivity, density and sonic logs, etc.).

The coupling of sensors providing information on the course of a well trajectory, in real time or near real time, with, for example, one or more logs characterizing the formations from a geological viewpoint, may allow for implementing a geosteering method. Such a method may include navigating a subsurface environment, for example, to follow a desired route to reach a desired target or targets.

As an example, a drillstring may include an azimuthal density neutron (ADN) tool for measuring density and porosity; a MWD tool for measuring inclination, azimuth and shocks; a compensated dual resistivity (CDR) tool for measuring resistivity and gamma ray related phenomena; one or more variable gauge stabilizers; one or more bend joints; and a geosteering tool, which may include a motor and optionally equipment for measuring and/or responding to one or more of inclination, resistivity and gamma ray related phenomena.

As an example, geosteering may include intentional directional control of a wellbore based on results of downhole geological logging measurements in a manner that aims to keep a directional wellbore within a desired region, zone (e.g., a pay zone), etc. As an example, geosteering may include directing a wellbore to keep the wellbore in a particular section of a reservoir, for example, to minimize gas and/or water breakthrough and, for example, to maximize economic production from a well that includes the wellbore.

Referring again to FIG. 2, the wellsite system 200 may include one or more sensors 264 that are operatively coupled to the control and/or data acquisition system 262. As an example, a sensor or sensors may be at surface locations. As an example, a sensor or sensors may be at downhole locations. As an example, a sensor or sensors may be at one or more remote locations that are not within a distance of the order of about one hundred meters from the wellsite system 200. As an example, a sensor or sensor may be at an offset wellsite where the wellsite system 200 and the offset wellsite are in a common field (e.g., oil and/or gas field).

As an example, one or more of the sensors 264 may be provided for tracking pipe, tracking movement of at least a portion of a drillstring, etc.

As an example, the system 200 may include one or more sensors 266 that may sense and/or transmit signals to a fluid conduit such as a drilling fluid conduit (e.g., a drilling mud conduit). For example, in the system 200, the one or more sensors 266 may be operatively coupled to portions of the standpipe 208 through which mud flows. As an example, a downhole tool may generate pulses that may travel through the mud and be sensed by one or more of the one or more sensors 266. In such an example, the downhole tool may include associated circuitry such as, for example, encoding circuitry that may encode signals, for example, to reduce demands as to transmission. As an example, circuitry at the surface may include decoding circuitry to decode encoded information transmitted at least in part via mud-pulse telemetry. As an example, circuitry at the surface may include encoder circuitry and/or decoder circuitry and circuitry downhole may include encoder circuitry and/or decoder circuitry. As an example, the system 200 may include a transmitter that may generate signals that may be transmitted downhole via mud (e.g., drilling fluid) as a transmission medium.

As an example, one or more portions of a drillstring may become stuck. The term stuck may refer to one or more of varying degrees of inability to move or remove a drillstring from a bore. As an example, in a stuck condition, it might be possible to rotate pipe or lower it back into a bore or, for example, in a stuck condition, there may be an inability to move the drillstring axially in the bore, though some amount of rotation may be possible. As an example, in a stuck condition, there may be an inability to move at least a portion of the drillstring axially and rotationally.

As to the term "stuck pipe", this may refer to a portion of a drillstring that may not be rotated or moved axially. As an example, a condition referred to as "differential sticking" may be a condition whereby the drillstring may not be moved (e.g., rotated or reciprocated) along the axis of the bore. Differential sticking may occur when high-contact forces caused by low reservoir pressures, high wellbore pressures, or both, are exerted over a sufficiently large area of the drillstring. Differential sticking may have time and financial cost.

As an example, a sticking force may be a product of the differential pressure between the wellbore and the reservoir and the area that the differential pressure is acting upon. This means that a relatively low differential pressure (delta p) applied over a large working area may be just as effective in sticking pipe as may a high differential pressure applied over a small area.

As an example, a condition referred to as "mechanical sticking" may be a condition where limiting or prevention of motion of the drillstring by a mechanism other than differential pressure sticking occurs. Mechanical sticking may be caused, for example, by one or more of junk in the hole, wellbore geometry anomalies, cement, keyseats or a buildup of cuttings in the annulus.

Figure 3:
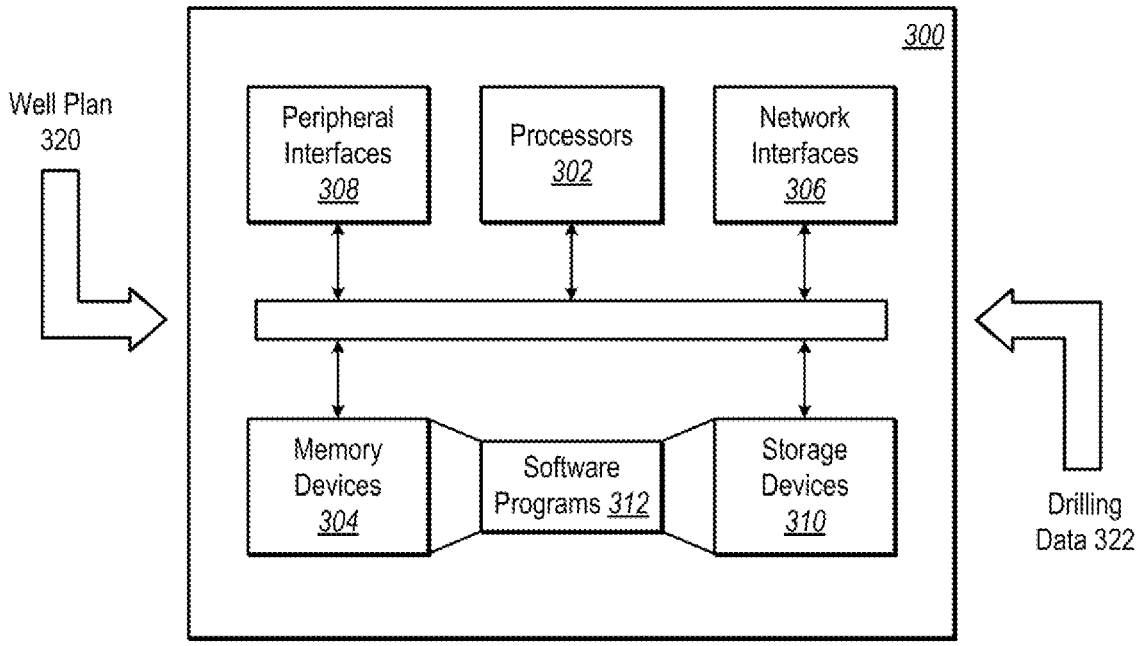
FIG. 3 illustrates an example computing system that may be used in connection with the drilling system, according to at least one embodiment of the present disclosure.

FIG. 3 illustrates a schematic view of such a computing or processor system 300, according to an embodiment. The processor system 300 may include one or more processors 302 of varying core configurations (including multiple cores) and clock frequencies. The one or more processors 302 may be operable to execute instructions, apply logic, etc. It will be appreciated that these functions may be provided by multiple processors or multiple cores on a single chip operating in parallel and/or communicably linked together. In at least one embodiment, the one or more processors 302 may be or include one or more GPUs.

The processor system 300 may also include a memory system, which may be or include one or more memory devices and/or computer-readable media 304 of varying physical dimensions, accessibility, storage capacities, etc. such as flash drives, hard drives, disks, random access memory, etc., for storing data, such as images, files, and program instructions for execution by the processor 302. In an embodiment, the computer-readable media 304 may store instructions that, when executed by the processor 302, are configured to cause the processor system 300 to perform operations. For example, execution of such instructions may cause the processor system 300 to implement one or more portions and/or embodiments of the method(s) described above.

The computer-readable media 304 may be any available media that may be accessed by a general purpose or special purpose computer system. Computer-readable media that store computer-executable instructions are non-transitory computer-readable storage media (devices). Computer-readable media that carry computer-executable instructions are transmission media. Thus, by way of example, and not limitation, embodiments of the disclosure may comprise at least two distinctly different kinds of computer-readable media: non-transitory computer-readable storage media (devices) and transmission media.

Non-transitory computer-readable storage media (devices) includes RAM, ROM, EEPROM, CD-ROM, solid state drives ("SSDs") (e.g., based on RAM), Flash memory, phase-change memory ("PCM"), other types of memory, other optical disk storage, magnetic disk storage or other magnetic storage devices, or any other medium which may be used to store desired program code means in the form of computer-executable instructions or data structures and which may be accessed by a general purpose or special purpose computer.

The processor system 300 may also include one or more network interfaces 306. The network interfaces 306 may include any hardware, applications, and/or other software. Accordingly, the network interfaces 306 may include Ethernet adapters, wireless transceivers, PCI interfaces, and/or serial network components, for communicating over wired or wireless media using protocols, such as Ethernet, wireless Ethernet, etc.

As an example, the processor system 300 may be a mobile device that includes one or more network interfaces for communication of information. For example, a mobile device may include a wireless network interface (e.g., operable via one or more IEEE 802.11 protocols, ETSI GSM, BLUETOOTH®, satellite, etc.). As an example, a mobile device may include components such as a main processor, memory, a display, display graphics circuitry (e.g., optionally including touch and gesture circuitry), a SIM slot, audio/video circuitry, motion processing circuitry (e.g., accelerometer, gyroscope), wireless LAN circuitry, smart card circuitry, transmitter circuitry, GPS circuitry, and a battery. As an example, a mobile device may be configured as a cell phone, a tablet, etc. As an example, a method may be implemented (e.g., wholly or in part) using a mobile device. As an example, a system may include one or more mobile devices.

The processor system 300 may further include one or more peripheral interfaces 308, for communication with a display, projector, keyboards, mice, touchpads, sensors, video cameras, closed-circuit television (CCTV), other types of input and/or output peripherals, and/or the like. In some implementations, the components of processor system 300 need not be enclosed within a single enclosure or even located in close proximity to one another, but in other implementations, the components and/or others may be provided in a single enclosure. As an example, a system may be a distributed environment, for example, a so-called "cloud" environment where various devices, components, etc. interact for purposes of data storage, communications, computing, etc. As an example, a method may be implemented in a distributed environment (e.g., wholly or in part as a cloud-based service).

As an example, information may be input from a display (e.g., a touchscreen), output to a display or both. As an example, information may be output to a projector, a laser device, a printer, etc. such that the information may be viewed. As an example, information may be output stereographically or holographically. As to a printer, consider a 2D or a 3D printer. As an example, a 3D printer may include one or more substances that may be output to construct a 3D object. For example, data may be provided to a 3D printer to construct a 3D representation of a subterranean formation. As an example, layers may be constructed in 3D (e.g., horizons, etc.), geobodies constructed in 3D, etc. As an example, holes, fractures, etc., may be constructed in 3D (e.g., as positive structures, as negative structures, etc.).

The memory device may be physically or logically arranged or configured to store data on one or more storage devices 310. The storage device 310 may include one or more file systems or databases in any suitable format. The storage device 310 may also include one or more software programs 312, which may contain interpretable or executable instructions for performing one or more of the disclosed processes. When requested by the processor 302, one or more of the software programs 312, or a portion thereof, may be loaded from the storage devices 310 to the memory devices for execution by the processor 302.

Those skilled in the art will appreciate that the above-described componentry is merely one example of a hardware configuration, as the processor system 300 may include any type of hardware components, including any accompanying firmware or software, for performing the disclosed implementations. The processor system 300 may also be implemented in part or in whole by electronic circuit components or processors, such as application-specific integrated circuits (ASICs) or field-programmable gate arrays (FPGAs).

The processor system 300 may be configured to receive a directional drilling well plan 320. As discussed above, a well plan is to the description of the proposed wellbore to be used by the drilling team in drilling the well. The well plan typically includes information about the shape, orientation, depth, completion, and evaluation along with information about the equipment to be used, actions to be taken at different points in the well construction process, and other information the team planning the well believes will be relevant/helpful to the team drilling the well. A directional drilling well plan will also include information about how to steer and manage the direction of the well.

The processor system 300 may be configured to receive drilling data 322. The drilling data 322 may include data collected by one or more sensors associated with surface equipment or with downhole equipment. The drilling data 322 may include information such as data relating to the position of the BHA (such as survey data or continuous position data), drilling parameters (such as weight on bit (WOB), rate of penetration (ROP), torque, or others), text information entered by individuals working at the wellsite, or other data collected during the construction of the well.

In one embodiment, the processor system 300 is part of a rig control system (RCS) for the rig. In another embodiment, the processor system 300 is a separately installed computing unit including a display that is installed at the rig site and receives data from the RCS. In such an embodiment, the software on the processor system 300 may be installed on the computing unit, brought to the wellsite, and installed and communicatively connected to the rig control system in preparation for constructing the well or a portion thereof.

In another embodiment, the processor system 300 may be at a location remote from the wellsite and receives the drilling data 322 over a communications medium using a protocol such as well-site information transfer specification or standard (WITS) and markup language (WITSML). In such an embodiment, the software on the processor system 300 may be a web-native application that is accessed by users using a web browser. In such an embodiment, the processor system 300 may be remote from the wellsite where the well is being constructed, and the user may be at the wellsite or at a location remote from the wellsite.

While the above describes details about particulars of a wellsite in connection with a drilling operation, other wellsite operations may also fall within the scope of this disclosure. The techniques described herein may be used during a wireline logging operation, a fishing operation, cementing, or other operations that may occur at a wellsite.

Figure 4:
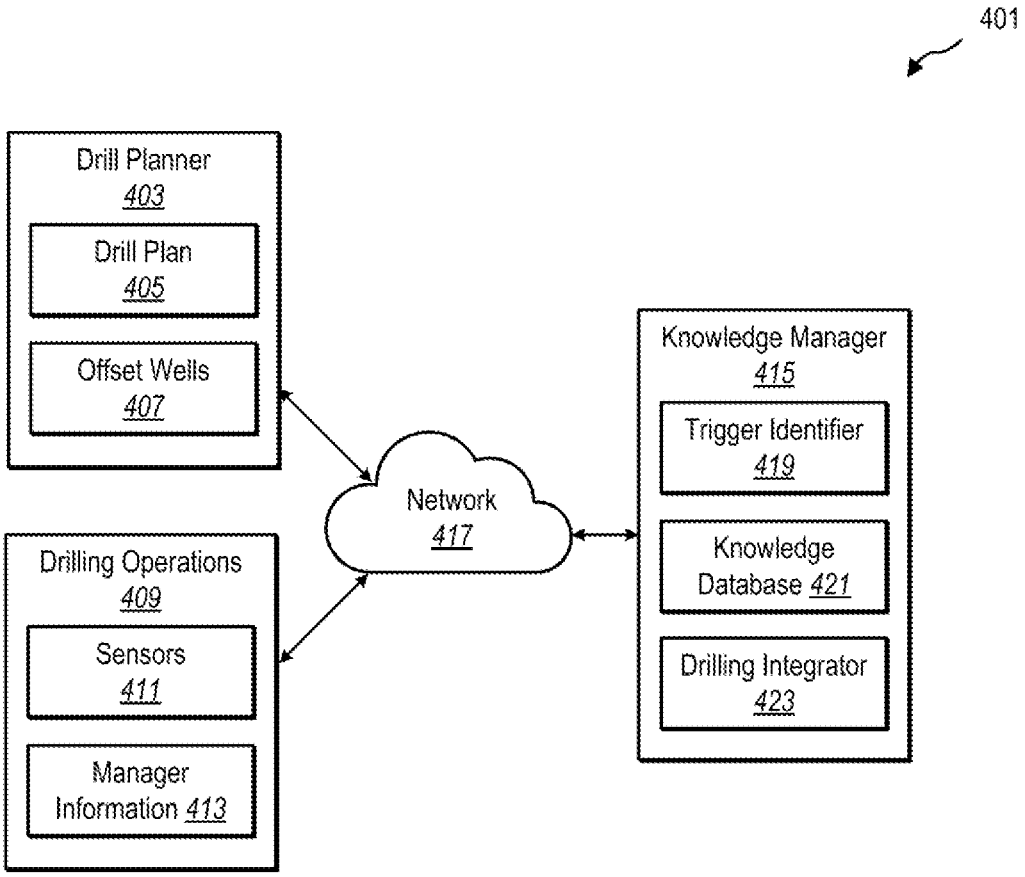
FIG. 4 is a representation of a drilling system, according to at least one embodiment of the present disclosure.

FIG. 4 is schematic representation of a drilling system 401, according to at least one embodiment of the present disclosure. The drilling system 401 includes a drill planner 403. The drill planner 403 may prepare a drill plan 405 for a wellbore. As discussed herein, the drill plan 405 may include any type of drill plan. For example, the drill plan 405 may include a series of acts that a set of drilling equipment may perform to drill a wellbore and/or otherwise perform operations in a wellbore.

In some embodiments, the drill plan 405 may be based at least in part on information from one or more offset wells 407. The one or more offset wells 407 may include wellbores that are drilled in the same geographical area, in the same formation, in the same basin, in the similar geographical areas, in similar formations, in similar basins, and combinations thereof.

The drilling system 401 may include drilling operations 409. The drilling operations 409 may implement the drill plan 405. The drilling operations 409 may include operating one or more sets of drilling equipment that are configured to perform the actions of the drill plan 405. To monitor the drilling operations 409, the drilling operations 409 may include one or more sensors 411. The sensors 411 may include a sensor suite. For example, the sensors 411 may include a sensor suite of multiple different sensors. The sensor suite may include multiple sensors that sense the same parameter, such as redundant sensors, sensors that sense the same parameter in different locations, sensors that sense different parameters, any other sensors, and combinations thereof.

The sensors 411 may be configured to monitor any type of drilling parameter of the drilling operations 409. For example, the sensors 411 may monitor surface drilling conditions. In some examples, the sensors 411 may monitor surface WOB (SWOB), surface torque on bit (STOB), rotational rate in rotations per minute (RPM), rate of penetration (ROP), drilling fluid flow rate, drilling fluid pressure, drilling fluid composition, drilling fluid physical properties (e.g., density, viscosity, conductivity), any other surface drilling conditions, and combinations thereof. In some examples, the sensors 411 may monitor downhole drilling conditions, such as downhole WOB (DWOB), downhole torque on bit (DTOB), downhole survey information, any other downhole drilling information, and combinations thereof. In some examples, the sensors 411 may monitor any other parameter, such as weather information, time of day, time of year, geographical location, any other parameter, and combinations thereof. In some embodiments, the drilling operations 409 may monitor any other information about the drilling operation. For example, the drilling operations 409 may monitor manager information 413. The manager information 413 may include any information about the drilling system, such as crew information, operator information, management team information, any other management information 413, and combinations thereof. In some embodiments, the sensors 411 may include other type of sensor information, such as video sensor information. For example, the sensors 411 may include video sensors that observe a workplace.

The drilling system 401 may include a knowledge manager 415. The knowledge manager 415 may receive information from the drill planner 403 and/or the drilling operations 409. In some embodiments, the knowledge manager 415 may receive information from the drill planner 403 and/or the drilling operations 409 over network 417, such as a local area network (LAN) or the Internet. In accordance with at least one embodiment of the present disclosure, the knowledge manager 415 may analyze the information from the drill planner 403 and/or the drilling operations 409 to identify one or more trigger events, as discussed in further detail herein. The knowledge manager 415, based on the identified trigger event, may prepare recommendations for the drilling operations 409 to mitigate the trigger event.

In some embodiments, the knowledge manager 415 may include a trigger identifier 419. The trigger identifier 419 may analyze drilling information received from the drilling operations 409 and identify whether a trigger event has occurred. A trigger event may be representative of a knowledge event. For example, the trigger identifier 419 may monitor sensor information measured by the sensors 411. The trigger identifier 419 may monitor the sensor information for abnormal sensor values. As discussed in further details herein, abnormal sensor values may be any sensor value that is outside of a threshold range of values. The threshold range of values may be set by the knowledge manager 415. For example, the threshold range of values may be identified based on a knowledge database 421.

In some embodiments, the trigger identifier 419 may identify the trigger event using any type of sensor data from the sensors 411. For example, the trigger identifier 419 may identify the trigger event using video data recorded from a video camera. The trigger identifier 419 may identify anomalous information captured from the video camera. For example, the trigger identifier 419 may identify the presence of personnel in a restricted area, and the trigger identifier 419 may identify a trigger event. In some examples, the trigger identifier 419 may identify a new process being performed by analyzing video footage. In some examples, the trigger identifier 419 may identify that a procedure was not properly followed in the video footage. The trigger identifier 419 may identify a trigger event based on this video footage.

If the trigger identifier 419 identifies that a measurement value is outside of the threshold range of values, then a drilling integrator 423 may implement a mitigation action to mitigate the event. For example, the drilling integrator 423 may prepare a recommendation for the drilling operations 409 to adjust one or more drilling parameters. The adjustment to the drilling parameters may be configured to cause the drilling operations 409 to operate within the threshold range of values. For example, adjusting the drilling parameters may include adjusting one or more surface drilling parameter, such as adjusting SWOB, STOB, RPM, drilling fluid flow rate, any other surface drilling parameter, and combinations thereof. In some examples, adjusting the drilling parameters may include adjusting a downhole drilling parameter, such as actuating a downhole tool, changing a status of a downhole tool, adjusting any other downhole drilling parameter, and combinations thereof. In some embodiments, adjusting a drilling parameter may include adjusting a management parameter, such as adjusting the employees on a shift, adjusting a management structure, adjusting a shift schedule, any other management adjustment, and combinations thereof.

In some embodiments, adjusting a drilling parameter may help to return the measured drilling information to within the threshold range. Returning the drilling information to within the threshold range may help to reduce and/or prevent damage to the drilling system from the trigger event. This may help to mitigate the causes of the trigger event.

As discussed herein, the knowledge manager 415 may retain a knowledge database 421 of knowledge from responses to various events. When the knowledge manager 415 identifies a trigger event, the knowledge manager 415 may cause the actions taken based on the trigger event to be recorded in the knowledge database 421. For example, when the knowledge manager 415 identifies a trigger event associated with an improved process, such as identifying that a new standard operating procedure (SOP) for a task was uploaded to the company server. The knowledge manager 415 may identify the new SOP, and the knowledge manager 415 may automatically record in the knowledge database 421 event information that precedes the change in process. In some examples, the knowledge manager 415 may record video footage recorded of the actions personnel took in response to a trigger event. The knowledge manager 415 may further request manual information be input into the knowledge database 421 that is associated with the new SOP. Manual information may help to capture information that may not otherwise be recorded, such as conversations at meetings, visual observations, feelings, impressions, and other unrecorded knowledge. In some embodiments, the manual information may complement the automatically recorded information. This recording of the knowledge associated with events may help to document knowledge gained through various mechanisms during drilling operations.

The knowledge recorded in the knowledge database 421 may include a knowledge type. A knowledge type may be a type of event about which the drilling system 401 has collected knowledge. Knowledge types may include any type of knowledge. In some embodiments, a knowledge type may include tacit knowledge. Tacit knowledge may be knowledge held by individuals that is typically based on experience. Tacit knowledge may be knowledge that is hard for an operator to define and/or describe. In some situations, tacit knowledge may be based on a "gut" feeling or otherwise based on hard-to-define factors.

In accordance with at least one embodiment of the present disclosure, the knowledge database 421 may identify tacit knowledge. For example, the knowledge database 421 may identify triggering events based on historical information identified by a drilling operator. For example, the drilling operator may identify an event based on his or her tacit knowledge. The knowledge manager 415 may collect drilling information from the drilling operations 409 for the event. In some embodiments, the knowledge manager 415 may identify patterns in the event and similar events to identify the trigger events. For example, the knowledge manager 415 may include a machine learning (ML) model. The ML model may be trained on information received from the drilling operations 409. The ML model may be trained to identify patterns based on identified events. The ML model may identify trigger events in the patterns. In this manner, the ML may identify trigger events to capture tacit knowledge from the drilling operator.

In some embodiments, the knowledge database 421 may include trigger events for explicit knowledge. Explicit knowledge may represent knowledge that is articulated and documented. Such knowledge may be derived from operating manuals, white papers, databases, patents, publications, any other explicit knowledge, and combinations thereof. In some embodiments, the trigger events for explicit knowledge events may be inputted into the knowledge database 421.

In some embodiments, the trigger events for explicit knowledge events may be identified using the ML model. For example, the ML model may be trained on the explicit knowledge. When the drilling system 401 identifies that an event has occurred, the ML model may analyze the information from the drilling operations 409. In some embodiments, the ML model may analyze information which may not be relevant to the trigger event based on the explicit knowledge. The ML model may identify other elements which may combine to identify the trigger event. This may help to identify the trigger event earlier and/or identify the trigger event with a greater level of confidence.

The knowledge types may include any type of knowledge type. For example, a knowledge type may include drilling conditions (e.g., sticking, stick-slip, loss of circulation), health and safety risks, risk mitigation, risk detection, near misses (e.g., actions that are close to a threshold for a trigger event, but do not pass the threshold and/or did not cause damage to people or property), improvements to drilling processes, updates and/or modifications to operating procedures, completion of incomplete operating procedures, new procedure proposal, non-mapped tasks, lessons learned, best practices (process optimization by performing a process differently than previously performed), any other knowledge type, and combinations thereof.

In accordance with at least one embodiment of the present disclosure, the drilling integrator 423 may, when a trigger event has been identified, implement a mitigating action. The mitigation action may include to mitigate the trigger event. For example, the mitigation action may include a change to one of the drilling parameters of the drilling operations 409. In some examples, the mitigation action may include a request for information from an operator. A request for information from an operator may include an entry of manual information about the event. The manual information may include any manual information, such as an explanation of the tacit knowledge associated with the event, an explanation of what the operator thinks caused the event, an explanation of what the operator thinks may mitigate and/or resolve the event, any other manual information, and combinations thereof.

In some examples, the mitigation action may include an alert. The alert may be prepared for and/or transmitted to the drilling operations 409. In some embodiments, the knowledge manager 415 may prepare the alert anytime a trigger event is identified. In some embodiments, the knowledge manager 415 may prepare the alert if a particular trigger event is identified. For example, the knowledge manager 415 may prepare the alert if a trigger event associated with a health and safety event is identified. In some examples, the knowledge manager 415 may prepare the alert if a trigger event associated with an opportunity to improve operational efficiency is identified. In some examples, the knowledge manager 415 may prepare the alert if a trigger event associated with a positive event is identified.

In some embodiments, the knowledge manager 415 may transmit the alert to the drilling operations 409. In some embodiments, the knowledge manager 415 may transmit the alert to a particular person and/or a particular set of people. In some embodiments, the knowledge manager 415 may utilize different levels of alerts. For example, the knowledge manager 415 may associate different trigger events with different alerts. The knowledge manager 415 may send different alerts to different people, based on the knowledge type and/or a severity of the alert. For example, a health and safety alert may be sent to a health and safety manager, and an operations alert may be sent to an operations manager.

In some embodiments, each alert may be associated with an alert severity. For example, a trigger event based on information that is significantly outside of the threshold range may be associated with a higher alert severity. A trigger event based on information that is just barely outside of the threshold range may be associated with a lower alert severity. For example, consider a set of drilling information that is typically distributed according to a normal distribution, such as samples of a drilling fluid density (e.g., mud weight). The threshold range for the set of drilling information may be plus or minus two standard deviations. The trigger identifier 419 may identify a trigger event if a measured mud weight is outside of the two standard deviation range. A measurement that is 2.1 standard deviations greater than the mean may be associated with a low severity (e.g., a green severity on a red, yellow, green scale). A measurement that is 3.5 standard deviations greater than the mean may be associated with a high severity (e.g., a red severity on a red, yellow, green scale). A measurement that is 2.6 standard deviations greater than the mean may be associated with a medium severity (e.g., a yellow severity on a red, yellow, green scale). The alerts for different severity levels may be sent to different people. For example, an alert for a green severity level may be sent to local wellsite management. An alert for a yellow severity level may be sent to regional management. An alert for a red severity level may be sent to corporate management. In this manner, the alert will be sent to higher levels of management, indicating an increasing level of priority. While the above example is provided with respect to levels of management, it should be understood that alerts may be sent with varying levels of urgency.

In accordance with at least one embodiment of the present disclosure, the knowledge manager 415 may automatically record trigger events, the actions associated with the trigger events, including information from the drill plan 405 and/or drilling operations 409, in the knowledge database 421. In particular, the knowledge manager 415 may record, in the knowledge database 421, the actions taken (e.g., the knowledge) by the drilling integrator 423 and/or other operator to return the drilling system to within the threshold range. In this manner, the knowledge manager 415 may record the knowledge learned from the trigger event. Recording the knowledge in the knowledge database 421 may help the knowledge manager 415 to more quickly implement the mitigation actions to return the drilling system to pre-event conditions. This may help to reduce inefficiencies in the drilling system 401.

In some embodiments, the knowledge manager 415 may predict one or more trigger events and implement mitigation actions to prevent the trigger event from occurring. For example, the knowledge manager 415 may receive information from the drilling operations 409. The trigger identifier 419 may identify that the measurements from the sensors 411 are trending toward a trigger event. For example, the trigger identifier 419 may identify that measurements from the sensors 411 are trending out of the threshold range of values for the sensors 411. In some examples, the trigger identifier 419 may identify that a particular combination of sensor measurements from multiple different sensors 411 are associated with the start of a trigger event and/or are a precursor for a trigger event. The trigger identifier 419 may identify the predicted trigger event, and the drilling integrator 423 may prepare a recommendation for and/or implement a mitigation action based on the predicted trigger event. In this manner, the knowledge manager 415 may help to improve the efficiency of the drilling system by reducing the severity of and/or preventing trigger events from occurring.

Figure 5:
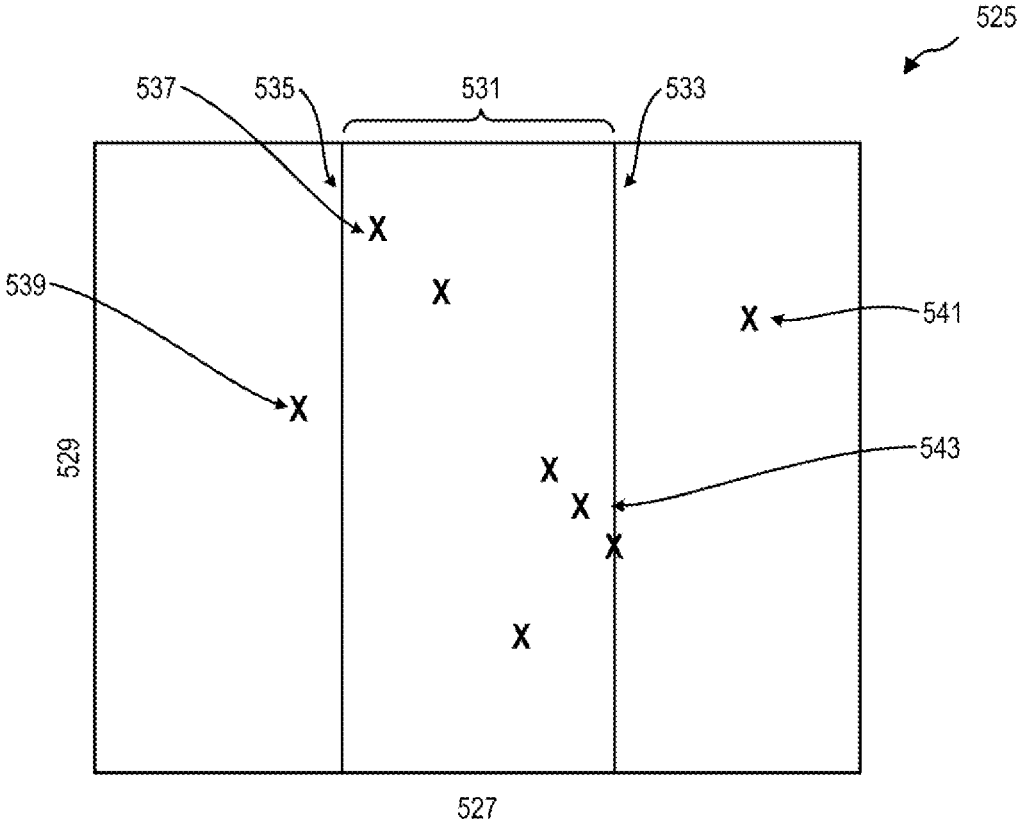
FIG. 5 is a representation of a pressure plot, according to at least one embodiment of the present disclosure.

FIG. 5 is an exemplary representation of a pressure plot 525 illustrating pressure 527 on the horizontal axis (e.g., x-axis) plotted against depth 529 on the vertical axis (e.g., y-axis), according to at least one embodiment of the present disclosure. The pressure plot 525 includes a threshold range 531. The threshold range 531 may be bounded by an upper threshold 533 and a lower threshold 535. The upper threshold 533 and the lower threshold 535 may be identified as the upper and lower limits on operating pressure for the drilling system. When a pressure measurement, such as a first pressure measurement 537, is measured within the threshold range 531, then no trigger event is identified.

When a pressure measurement is measured outside of the threshold range 531, then the trigger identifier may identify a trigger event. For example, when a second pressure measurement 539 is measured with a value below the lower threshold 535, the trigger identifier may identify a trigger event associated with low fluid pressure. This may be caused by a pump failure, a loss of circulation, or any other event. In some examples, when a third pressure measurement 541 is measured with a value above the upper threshold 533, the trigger identifier may identify a trigger event associated with high fluid pressure. This may be caused by a pump failure, a clogged annulus, or any other event.

In some examples, the trigger identifier may identify a trigger event based on a trend 543 of pressure measurements. For example, in the embodiment shown, each of the measurements in the trend 543 are located within the threshold range 531. The trigger identifier may identify that one of the next measurements is likely to be located outside of the threshold range 531, or larger than the upper threshold 533. The trigger identifier may identify a trigger event based on this trend. The knowledge manager may prepare a mitigating action to mitigate the trend 543 of pressure measurements to reduce the impact of the trend 543 of pressure measurements. For example, the knowledge manager may cause a change in one or more drilling parameters, such as SWOB, STOB, drilling fluid flow rate, RPM, any other drilling parameter, and combinations thereof. This may help to reduce or prevent damage to the drilling operation based on the trend 543 in pressure measurements.

In some embodiments, the knowledge manager may generate different types of alerts based on which of the trigger events the trigger identifier identifies. For example, the knowledge manager may generate a low-pressure trigger alert for the first pressure measurement 537. The knowledge manager may generate a high-pressure trigger alert for the second pressure measurement 539. The knowledge manager may generate a trending-pressure trigger alert for the trend 543 in pressure measurements. This may help the drilling operator and/or the knowledge manager to prepare mitigating actions for the drilling system.

Figure 6:
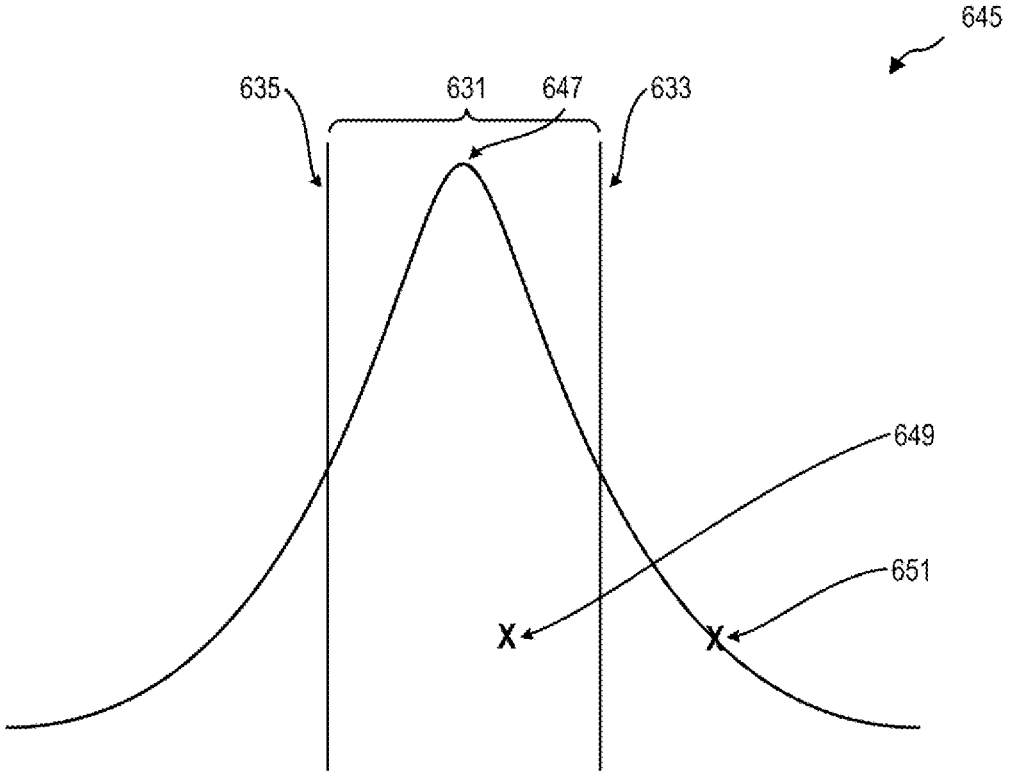
FIG. 6 is a representation of a sensor plot, according to at least one embodiment of the present disclosure.

FIG. 6 is a representation of a sensor plot 645, according to at least one embodiment of the present disclosure. The sensor plot 645 may be representative of downhole sensor information, such as power generation sensor information at a downhole mud motor. The sensor plot 645 illustrated shows a normal plot, or a plot having a normal statistical distribution. When the knowledge manager receives a sensor measurement, the trigger identifier may identify whether the sensor measurement is representative of a trigger event. For example, the trigger identifier may identify whether the sensor measurement is within a threshold range 631 of the sensor plot 645.

The threshold range 631 may be determined based on a range of standard deviations from the mean 647 of the plot. The mean 647 of the plot may be the average value or the peak of the normal distribution. The threshold range 631 may be bounded by an upper threshold 633 and a lower threshold 635. The upper threshold 633 may be any number of standard deviations greater than the mean 647, such as one, two, three, four, or any value therebetween. The lower threshold 635 may be any number of standard deviations less than the mean 647, such as one, two, three four, or any value therebetween.

When the knowledge manager receives a first sensor measurement 649, the trigger identifier may identify that the first sensor measurement 649 is within the threshold range 631. This may indicate that the power measurement value is within the anticipated range of power values. In some embodiments, when the knowledge manager receives a second sensor measurement 651, the trigger identifier may identify that the second sensor measurement 651 is outside of the threshold range 631. For example, the trigger identifier may identify that the second sensor measurement 651 is greater than the upper threshold 633. The trigger identifier may identify a trigger event based on the second sensor measurement 651. The trigger event may be based on a knowledge type associated with the mud motor generating too much power, which could damage downhole electrical systems. When the trigger identifier identifies the trigger event, the knowledge manager may prepare a mitigation action, such as reducing the fluid flow rate to reduce the power generation of the downhole motor.

Figure 7:
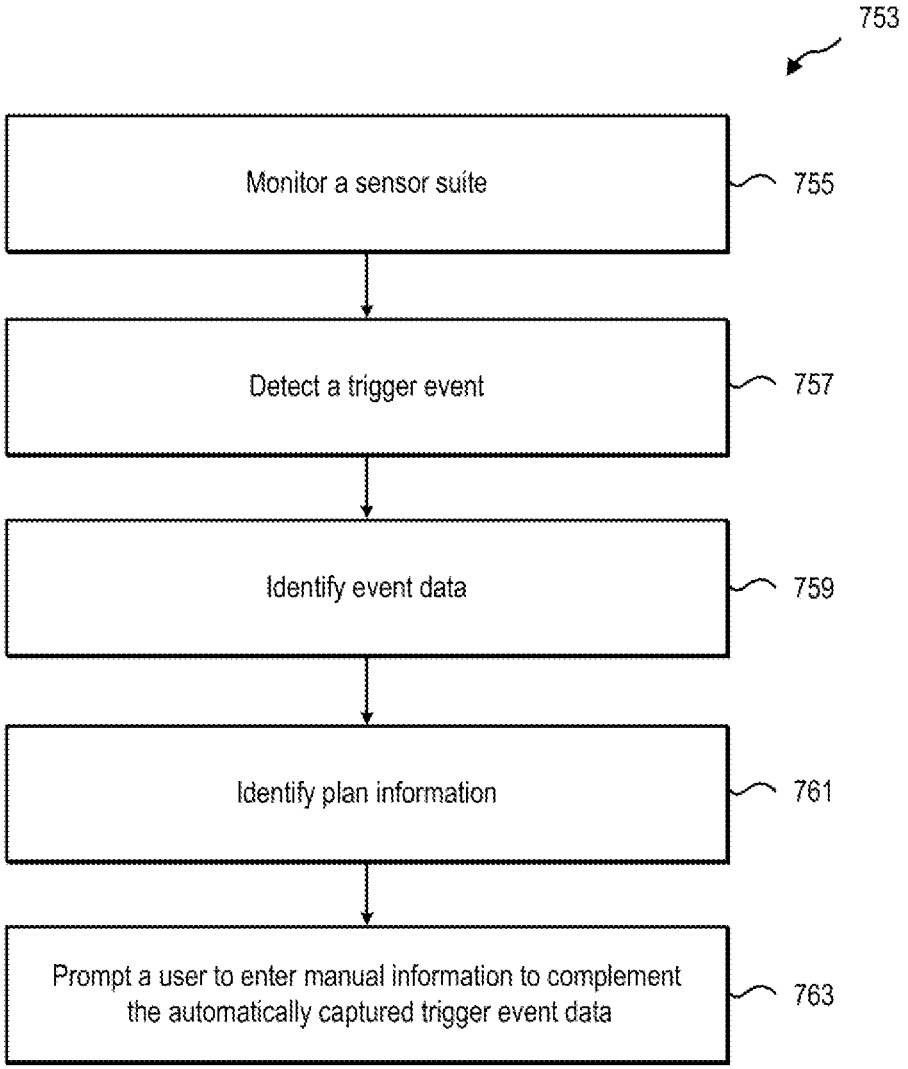
FIG. 7 is a flowchart of a method for managing a drilling system, according to at least one embodiment of the present disclosure.
Figure 8:
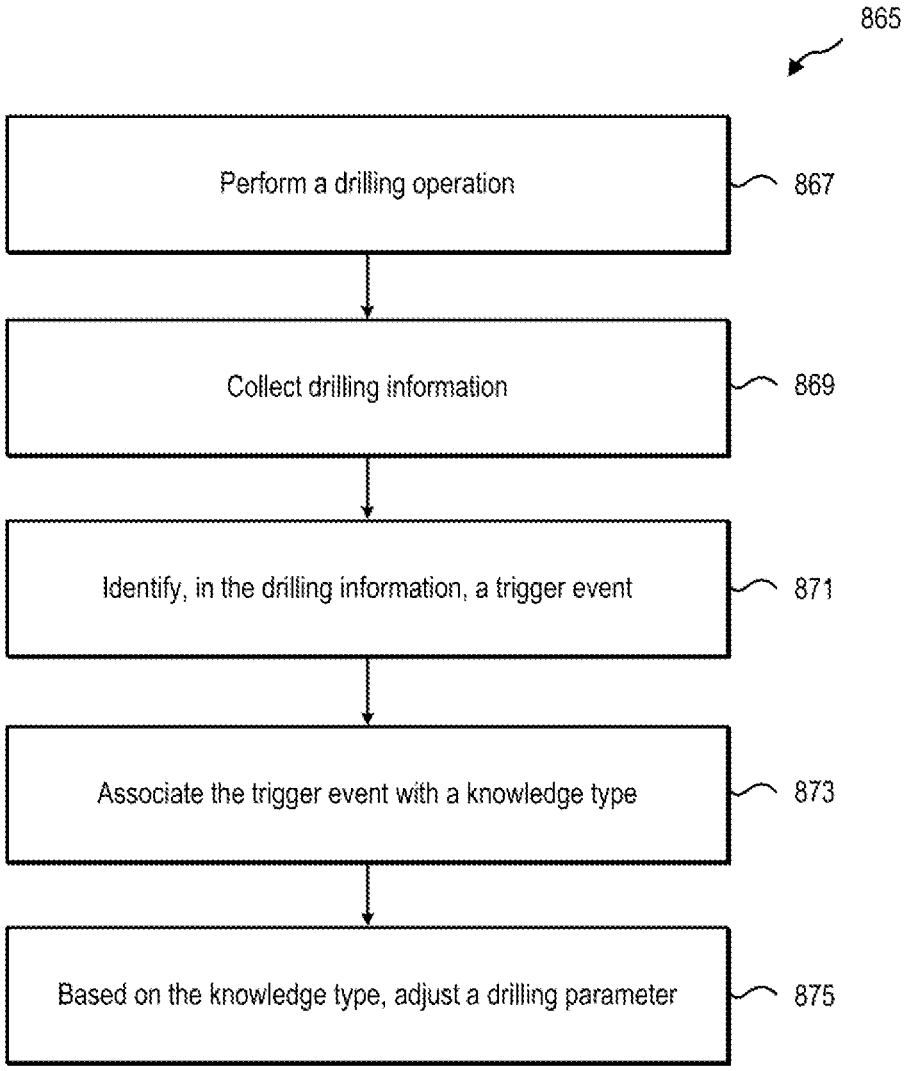
FIG. 8 is a flowchart of a method for managing a drilling system, according to at least one embodiment of the present disclosure.

FIGS. 7 and 8, the corresponding text, and the examples provide a number of different methods, systems, devices, and computer-readable media of the drilling system. In addition to the foregoing, one or more embodiments may also be described in terms of flowcharts comprising acts for accomplishing a particular result, as shown in FIGS. 7 and 8. FIGS. 7 and 8 may be performed with more or fewer acts. Further, the acts may be performed in differing orders. Additionally, the acts described herein may be repeated or performed in parallel with one another or parallel with different instances of the same or similar acts.

As mentioned, FIG. 7 illustrates a flowchart of a method 753 of a series of acts for identifying and/or mitigating trigger events, in accordance with one or more embodiments. While FIG. 7 illustrates acts according to one embodiment, alternative embodiments may omit, add to, reorder, and/or modify any of the acts shown in FIG. 7. The acts of FIG. 7 may be performed as part of a method. Alternatively, a computer-readable medium may comprise instructions that, when executed by one or more processors, cause a computing device to perform the acts of FIG. 7. In some embodiments, a system may perform the acts of FIG. 7.

A knowledge manager may monitor a sensor suite at 755. The sensor suite collects drilling information about a drilling system during a wellsite operation. The drilling system performs drilling operations according to a well plan. A trigger identifier may detect a trigger event during the wellsite operation at 757. The trigger identifier may identify the trigger event by identifying that at least a portion of the drilling information is outside of a threshold range of the drilling information.

In response to detecting the trigger event, the knowledge manager may identify event data from the sensor suite at the time of the trigger event at 759. The knowledge manager may further identify plan information from the drill plan that describes the activity being performed during the wellsite operation when the trigger event was detected at 761. For example, when the trigger event is identified, the knowledge manager may identify any type of event data. The event data may be directly related to the trigger event. For example, the event data may be data from the same sensor for a period of time before and after the trigger event is identified. In some examples, the event data may include other sensor information, including sensor information that may otherwise be considered unrelated. For example, the trigger event may include identifying that the SWOB is greater than a threshold. The event data may include drilling parameters, such as STOB, drilling fluid flow rate, drilling fluid pressure, and so forth. The event data may include other parameters, such as the weather for the day, the crew on shift, any other parameters, and combinations thereof.

In accordance with at least one embodiment of the present disclosure, the knowledge manager may prompt a user to enter manual information about the trigger event at 763. The manual information may complement the automatically gathered or collected information. Prompting the user to enter manual information about the trigger event may help to collect information that may not be collected by a sensor, part of the event data, and/or part of the plan information. The user may enter manual information in any manner, such as through free-form text, selecting elements from a drop-down list, selecting elements from radial buttons, entering manual information in any other manner, and combinations thereof. Entering manual information may help to collect the tacit information that may not be readily identifiable by collected information and/or may not be highlighted by the event data and/or the plan information.

As mentioned, FIG. 8 illustrates a flowchart of a method 865 of a series of acts for identifying and/or mitigating trigger events, in accordance with one or more embodiments. While FIG. 8 illustrates acts according to one embodiment, alternative embodiments may omit, add to, reorder, and/or modify any of the acts shown in FIG. 8. The acts of FIG. 8 may be performed as part of a method. Alternatively, a computer-readable medium may comprise instructions that, when executed by one or more processors, cause a computing device to perform the acts of FIG. 8. In some embodiments, a system may perform the acts of FIG. 8.

A drilling system may perform a drilling operation at 867. The drilling operation may include any drilling operation, such as advancing a wellbore, reaming a wellbore, inserting a dogleg, casing installation, any other drilling operation, and combinations thereof. A knowledge manager may collect drilling information for the drilling operation from one or more sensors at 869. A trigger identifier may identify, in the drilling information, a trigger event at 871. The trigger event may include a deviation from a threshold range of at least a portion of the drilling information. For example, the drilling information may deviate from the threshold range by being greater than an upper threshold. In some examples, the drilling information may deviate from the threshold range by being less than a lower threshold.

The knowledge manager may associate the trigger event with a knowledge type at 873. The knowledge type may be any knowledge type, as discussed herein. In some embodiments, the knowledge type may be based on the trigger event. The knowledge manager may, based on the knowledge type, adjust a drilling parameter to return the drilling information to within the threshold range at 875.

In one embodiment, triggers are used to facilitate capturing knowledge and information about events. The resulting records may be used to help with operations of the well being drilled or other wells being drilled or planned. The knowledge may include time stamps, along with context data about the state of the rig and the operations being performed at the time of the trigger event and, potentially, a certain period of time before and after the trigger event. This may be used to capture information about lessons learned, best practices, and risks. In one embodiment, when a new trigger is detected, the system automatically takes a snapshot of sensor data, the procedure under execution, a timestamp, the current depth, and other information. One or more individuals may also be prompted to enter information about the event. In one embodiment, the individual is prompted to select certain labels and categories for the event and provide comments to describe the situation. This may be in addition to automatic labels created by the system.

The triggers may come from several sources such as manuals inputs, real-time sensor data, engines monitoring drilling performance, algorithms monitoring drilling risks, downhole tool sensors, and more. The triggers may activate when detecting a difference (customizable level of difference) between the plan and actual values. For example, plan (or modeled) versus actual activity durations, trajectory parameters such as inclination and azimuth, system pressures, flow out or fluid returns, stuck pipe risks above a certain threshold, low-pressure risks above a certain threshold, well-control risks above a certain threshold, and more. The triggers may be divided into categories that are art of the knowledge capture workflow.

In certain embodiments, a more robust information capturing system may be implemented using trigger events to facilitate capturing relevant information. When the trigger event occurs, the system may automatically capture the relevant contextual data and may prompt the user to provide more information about the trigger event. This combined record of automatically captured data and user-generated data about particular trigger events may facilitate better knowledge management and reporting.

In one embodiment, the approach involves a computer system such as that shown in FIG. 3 that stores instructions on a non-transitory computer readable medium. The computer system may be implemented at the wellsite on, for example, a rig. The computer system may be implemented on a mobile device such as a tablet, laptop, phone, or other that is used by personnel at the wellsite. In certain embodiments, the computer system may be implemented on a remote server and the functionality described herein is executed on the remote server. Certain users may be located at a remote operations site that is monitoring data and activity at the wellsite. In other embodiments, the instructions are implemented across various computer systems to allow users at various location to provide information about trigger events.

The system may detect a trigger event during a wellsite operation such as drilling, a wireline logging operation, or other. The trigger event may be a drilling dysfunction (such as stick-slip, BHA whirl, or others), a near-miss event, or a deviation from the plan. For example, a stuck pipe incident (or a near-miss of a stuck pipe incident) may be a trigger event. Lost circulation may be a trigger event. The BHA actual position deviating from a planned trajectory may be a trigger event. A period of unplanned NPT may be a trigger event. A change in the plan or a replanning event may be a trigger event. The driller using drilling parameters (such as WOB or ROP) that differ from the planned drilling parameters by a threshold amount may be a trigger event. Other events where a team may find it helpful to have a deeper understanding of the wellsite information and/or input from the wellsite personnel may also serve as trigger events.

In response to detecting the trigger event, the system may collect information. For example, in response to detecting the trigger event may indicate that the action may only occur once the trigger event has been identified. In one embodiment, this information includes event data from systems and sensors at the time of the trigger event. For example, the system may record surface sensor data and/or downhole system data at the time of the event trigger. In certain embodiments, the system may select data for a period before and/or after the trigger event to provide richer information about system and sensor data leading up to and following the trigger event.

In one embodiment, the system and sensor data that is stored may depend on the trigger. For example, a stick-slip event may record data streams about drilling parameters in greater detail/granularity as part of the data capture. For loss of circulation, the system may record data streams about pressure and fluids in greater detail/granularity.

The event data may include a variety of system and sensor data. Event data may include, for example, a time stamp, a current depth, the actual drilling parameters being used at the time of the event, the surface sensor readings, and the actual procedure being executed at the time of the trigger event (e.g., tripping, drilling, POOH, etc.).

The plan information may include information about what the planned activity was at the time of the trigger event. It may include, for example, what the planned activity was at the particular time and/or the planned activity at the particular depth. It may also include the planned parameters for the operation at that time. For example, it may include the planned ROP and WOB for drilling. It may include the planned tripping speed. The plan information may also include information about the standard operating procedures for the particular activity being executed at the wellsite. The SOPs may specify a particular sequence of events to accomplish the planned activity.

The system may also prompt one or more users to provide information about the trigger event. In one embodiment, the manual information provided by the user may be a label, a categorization, and/or free text. For example, the system may ask the user to label the severity of the drilling event. The system may ask the user to provide comments and context about what the user believed to be the cause of the trigger event and planned remedial actions.

In certain embodiments, the system may prompt multiple users to provide information about the trigger event. For example, a fluids specialist may be prompted to provide information about the status of the fluids for the trigger event while a driller may provide information about the drilling parameters. In one embodiment, the system maintains an association of roles and trigger events such that the system may route requests for information to appropriate personnel and may tailor the request for information to the individual's role in the operation and area of expertise.

Detecting the trigger event may involve the system monitoring various data sources and systems. For example, the system may monitor surface sensor data, rig data made available via a rig control system (RCS) or a WITSML server, downhole data, manual entry of information in reporting systems (such as daily drilling report generating software), plan information, or a combination of the above. The detection engine may include systems for identifying trigger events using sources of data such as those described in the example above.

In one embodiment, the system associates the trigger event, the event data, and the user-generated information and stores it in a data store such as a database. The system may generate a record of the trigger event comprising one or more of the elements described herein. The system may be configured to generate a report of one or more of the trigger events. For example, the system may generate a report of all trigger events after completion of the well.

In another embodiment, the system generates a report of the trigger events for one or more wells that have been completed and records trigger events in the system. This repository may thus record information for multiple wells. The wells may be for the particular region, basin, or across the world.

The system may generate dynamic reports based on specified criteria. In one embodiment, a team may want to understand stick-slip events in more detail and generate a report of stick-slip events for all wells drilled using the system described herein. In another embodiment, a team may generate a well plan for a well to be drilled. The system may compare the well plan with the well plans for multiple wells within the same region or that are otherwise similar to the well plan. Based on the comparison, the system may generate a report of trigger events that are likely to occur or at risk of occurring for the well to be drilled using the drill plan. The comparison may specify a likelihood of the trigger event occurring and may provide additional information such as the depth or time at which the trigger event is likely to occur.

In one embodiment, the report is generated for a different team during construction of the same well. Such an approach may facilitate knowledge transfer and reduce the likelihood of problems due to knowledge list during crew changes.

Examples of user content may be, for example, possible sources of NPT or ILT. The user may specify 'I tried procedure x and saved x amount of hours.' It may provide information about risks ('I had losses while drilling at xxx'). It may provide information about risk mitigation ('When I reduced RPMs to xx, it mitigated the S&V'). It may provide information about quality near misses (close to getting stuck or losses), quality improvement plans (new ideas to enhance a process), CL/OpNotes updates and modifications ('The checklist does not have "verify valve is closed" as a step'), incomplete procedures, proposals ('We could save 1 hour if we modify the BOP testing procedure here'), non-mapped risks ('I remember that in one well, a few years ago, we had a blow out in this formation. That information does not appear in the risk list').

In certain embodiments, the system may allow the user to create a knowledge management entry at any point, whether or not a trigger event has occurred. This manual entry may trigger data collection as specified herein as well as labeling and free text entry by a user.

In one embodiment, the system implements a flow where, at the planning stage, planning is done using the knowledge and information captured during previous wellsite operations. This may be used in generating the client well proposal, offset well analysis, preparing the drilling program, or other activity. The captured information may be used for all relevant planning activities.

During the execution phase, additional information may be captured by the system. The system captures additional information as trigger events occur. In addition to negative events, the trigger events may also be positive events such as better than expected performance. In response to detecting a trigger event triggered by gaining a result that was better than anticipated, the system may prompt for information about what modifications were made by the team to achieve the approved results. The entry may be labeled or classified appropriately as an improved result trigger event.

The system may also have users and/or systems validate the information it gathers. In one embodiment, at the end of a period of time (a day, week, etc.) the system prepares a report of trigger events and manual entries. These may be reviewed and modified by one or more individuals to validate the information and knowledge before it is stored in the repository.

The system may also index and/or label the data based on the individual entering it.

The embodiments disclosed in this disclosure are to help explain the concepts described herein. This description is not exhaustive and does not limit the claims to the precise embodiments disclosed. Modifications and variations from the exact embodiments in this disclosure may still be within the scope of the claims.

Likewise, the steps described need not be performed in the same sequence discussed or with the same degree of separation. Various steps may be omitted, repeated, combined, or divided, as appropriate. Accordingly, the present disclosure is not limited to the above-described embodiments, but instead is defined by the appended claims in light of their full scope of equivalents. In the above description and in the below claims, unless specified otherwise, the term "execute" and its variants are to be interpreted as pertaining to any operation of program code or instructions on a device, whether compiled, interpreted, or run using other techniques.

The claims that follow do not invoke section 112(*f*) unless the phrase "means for" is expressly used together with an associated function.

What is claimed is:

1. A non-transitory computer readable medium having stored therein instructions executable by a computer system to cause the computer system to:

monitor a sensor suite, the sensor suite collecting drilling information about a drilling system during a wellsite operation, the drilling system performing drilling operations according to a drill plan, wherein the drilling information includes pressure measurements;

detect, via a machine learning model trained on knowledge in a knowledge database, a trigger event during the wellsite operation by identifying that at least a portion of the drilling information is outside of a threshold range of the drilling information, wherein the knowledge in the knowledge database includes explicit knowledge and tacit knowledge, and wherein the threshold range is a pressure threshold range and detecting the trigger event includes detecting that the pressure measurements are outside of the pressure threshold range;

in response to detecting the trigger event:

identify event data from the sensor suite at a time of the trigger event, the event data including unrelated data not relevant to the trigger event;

identify plan information from the drill plan that describes an activity being performed during the wellsite operation when the trigger event was detected; and generate one of a plurality of alerts based on the event data, the plurality of alerts including a high pressure alert, a low pressure alert, and a trending pressure alert;

responsive to the one of the plurality of alerts, prompt a user associated with the one of the plurality of alerts to enter manual information about the trigger event, the manual information including new tacit knowledge not included in the drilling information or the event data;

prepare a recommendation to adjust drilling parameters based on the trigger event, wherein the recommendation includes adjusting a drilling fluid flow rate to return the pressure measurements to within the pressure threshold range;

implement, via a drilling integrator, the recommendation in the drilling system by automatically adjusting the drilling parameters at the drilling system and providing pump instructions to a pump to adjust the drilling fluid flow rate and return the pressure measurements to within the pressure threshold range;

add the drilling information, the event data, the plan information, the manual information, and the recommendation to the knowledge database; and train the machine learning model on the drilling information, the event data, the plan information, and the manual information added to the knowledge database.

2. The non-transitory computer readable medium of claim 1, wherein detecting the trigger event includes detecting at least one of a drilling dysfunction, a likelihood of the drilling dysfunction, a near-miss event, or a deviation from the drill plan.

3. The non-transitory computer readable medium of claim 1, wherein prompting the user to enter the manual information includes prompting the user to enter at least one of a label of the trigger event, a categorization of the trigger event, or free text related to the trigger event.

4. The non-transitory computer readable medium of claim 1, wherein the event data comprises at least one of a time stamp, a current depth, measured drilling parameters, surface sensor readings, or an actual procedure being executed.

5. The non-transitory computer readable medium of claim 1, wherein the plan information comprises at least one of a planned activity, standard operating procedures, or planned drilling parameters.

6. The non-transitory computer readable medium of claim 1, wherein monitoring the sensor suite includes monitoring at least one of a multi-sensor system, manual entries by personnel in reporting systems, surface sensor information, downhole sensor information, recorded video, or the plan information.

7. The non-transitory computer readable medium of claim 1, wherein the instructions are executable by the computer system to cause the computer system to generate a likelihood of one or more trigger events occurring for a planned wellbore.

8. The non-transitory computer readable medium of claim 1, wherein the unrelated data includes weather and a crew on shift.

9. The non-transitory computer readable medium of claim 1, wherein the plurality of alerts include an alert type and an alert severity, and wherein the user associated with the one of the plurality of alerts has an associated level of management.

10. A method for monitoring a drilling system, the method comprising:

performing a drilling operation;

collecting drilling information for the drilling operation from one or more sensors, wherein the drilling information includes pressure measurements;

applying the drilling information as input to a machine learning model trained on knowledge in a knowledge database to identify a trigger event, the trigger event including a deviation from a threshold range of at least a portion of the drilling information, wherein the knowledge in the knowledge database includes explicit knowledge and tacit knowledge, and wherein the threshold range is a pressure threshold range and identifying the trigger event includes detecting that the pressure measurements are outside of the pressure threshold range;

associating the trigger event with a knowledge type;

using the knowledge type, identifying event data from the drilling information at a time of the trigger event, the event data including unrelated data not relevant to the trigger event;

generating one of a plurality of alerts based on the event data, the plurality of alerts including a high pressure alert, a low pressure alert, and a trending pressure alert;

responsive to the one of the plurality of alerts, prompting a user associated with the one of the plurality of alerts to enter manual information about the trigger event, the manual information including new tacit knowledge not included in the drilling information or the event data;

using the knowledge type, preparing a recommendation to adjust drilling parameters based on the trigger event, wherein the recommendation includes adjusting a drilling fluid flow rate to return the pressure measurements to within the pressure threshold range;

adjusting the drilling parameters to return the drilling information to within the threshold range by adjusting the drilling fluid flow rate and returning the pressure measurements to within the pressure threshold range;

adding the drilling information, the event data, the manual information, and the recommendation to the knowledge database; and training the machine learning model on the drilling information, the event data, and the manual information added to the knowledge database.

11. The method of claim 10, wherein adjusting the drilling parameters includes instructing a drilling operator to adjust a procedure.

12. The method of claim 10, wherein the one of the plurality of alerts includes a severity level based on at least one of the knowledge type or the deviation from the threshold range.

13. A system comprising:

a drilling system that performs a drilling operation;

one or more sensors configured to sense drilling information about the drilling system;

a processor and memory, the memory including instructions which cause the processor to:

collect the drilling information for the drilling operation from the one or more sensors, wherein the drilling information includes pressure measurements;

apply the drilling information as input to a machine learning model trained on knowledge in a knowledge database to identify a trigger event, the trigger event including a deviation from a threshold range of at least a portion of the drilling information, wherein the knowledge in the knowledge database includes explicit knowledge and tacit knowledge, and wherein the threshold range is a pressure threshold range and identifying the trigger event includes detecting that the pressure measurements are outside of the pressure threshold range;

associate the trigger event with a knowledge type;

using the knowledge type, identify event data from the drilling information at a time of the trigger event, the event data including unrelated data not relevant to the trigger event;

generate one of a plurality of alerts based on the event data, the plurality of alerts including a high pressure alert, a low pressure alert, and a trending pressure alert;

responsive to the one of the plurality of alerts, prompt a user associated with the one of the plurality of alerts to enter manual information about the trigger event, the manual information including new tacit knowledge not included in the drilling information or the event data;

using the knowledge type, prepare a recommendation to adjust drilling parameters based on the trigger event, wherein the recommendation includes adjusting a drilling fluid flow rate to return the pressure measurements to within the pressure threshold range;

based on the knowledge type, adjust the drilling parameters to return the drilling information to within the threshold range by adjusting the drilling fluid flow rate and returning the pressure measurements to within the pressure threshold range;

add the drilling information, the event data, the manual information, and the recommendation to the knowledge database; and train the machine learning model on the drilling information, the event data, and the manual information added to the knowledge database.

* * * * *